United States Patent [19]

Flannery

[11] Patent Number: 5,031,438

[45] Date of Patent: Jul. 16, 1991

[54] APPARATUS FOR REPAIRING DAMAGED VEHICLES

[76] Inventor: Bevan M. Flannery, 63 Colches St., Casino, Australia, 2470

[21] Appl. No.: 497,225

[22] Filed: Mar. 22, 1990

[51] Int. Cl.[5] ..... B21D 1/12

[52] U.S. Cl. ..... 72/305; 72/705

[58] Field of Search ..... 72/305, 308, 422, 457, 72/705

[56] References Cited

U.S. PATENT DOCUMENTS

| | | | |
|---|---|---|---|
| 3,122,194 | 2/1964 | Bronson et al. | 72/705 |
| 3,492,855 | 2/1970 | Wylie . | |
| 3,501,938 | 3/1970 | Sprague | 72/705 |
| 3,581,547 | 6/1971 | Estigarribia | 72/705 |
| 4,158,303 | 6/1979 | Horn et al. | 72/705 |
| 4,344,314 | 8/1982 | Aldrich et al. | 72/705 |
| 4,516,423 | 5/1985 | Reich | 72/705 |
| 4,658,628 | 4/1987 | Grace . | |

FOREIGN PATENT DOCUMENTS 0163216 4/1985 European Pat. Off. .

*Primary Examiner*—Lowell A. Larson

*Attorney, Agent, or Firm*—Peter D. Keefe

[57] ABSTRACT

The apparatus includes a base frame 10; an assembly of carrier beams 17, 18 pivoted on the base frame 10 for rotation about an upright axis; clamps 19, 23 adjustably mounted on the carrier beams 17, 18 for clamping a vehicle supported on the carrier beams; retaining means 34 for releasably locking the assembly of carrier beams 17, 18 in rotatably adjusted position; a standard 36 on the base 10; and tensioning means 48, 50 mounted for vertical adjustment on the standard 36, for connection by a chain 51 direct or via a beam 52 and a further chain to parts of a vehicle clamped on the rotatable carrier beam assembly 17, 18. The tensioning means 48, 50 comprises a hydraulic cylinder 48 swingable about the standard 36 and an associated yoke 50.

9 Claims, 2 Drawing Sheets

APPARATUS FOR REPAIRING DAMAGED VEHICLES

BACKGROUND OF THE INVENTION

1. Field of the Invention

This invention relates to apparatus for use in repairing damaged vehicles.

2. Prior Art

The chassis and body of a car damaged in an accident are likely to require fairly extensive repairs including careful and accurate straightening and correction of deformation. Apparatus to facilitate this, by the application of hydraulically applied tension in any required direction, is well-known }e.g. see EP No. 0163216 (Gramlich); U.S. Pat. No. 4,658,628 (Grace); U.S. Pat. No. 3,492,855 (Wylie)}. Such known apparatus, however, is very costly and also very large, and so it is not well-suited to small or medium-sized crash-repair shops, both because of the capital cost involved, and also the space required to accommodate it.

SUMMARY OF THE PRESENT INVENTION

The present invention has been devised with the general object of providing vehicle repair apparatus which, although suited to economical construction and convenient storage, is capable of handling efficiently the correction of the great majority of accident-related damage short of that which may be expected to cause a vehicle to be written-off as beyond repair.

With the foregoing and other objects in view, the invention resides broadly, in apparatus for use in repairing damaged vehicles including a base, an assembly of carried beams pivoted on the base, vehicle clamps adjustably mounted on the carrier beams, a standard on the base, and hydraulic tensioning means mounted adjustably on the standard for connection by a chain or the like to parts of a vehicle clamped on the rotatable beam assembly. Other features of the invention will become apparent from the following description.

BRIEF DESCRIPTION OF THE DRAWINGS

In order that a preferred embodiment of the invention may be readily understood and carried into practical effect, reference is now made to the accompanying drawings, wherein.

DETAILED DESCRIPTION OF THE PREFERRED EMBODIMENT

Figure 1:
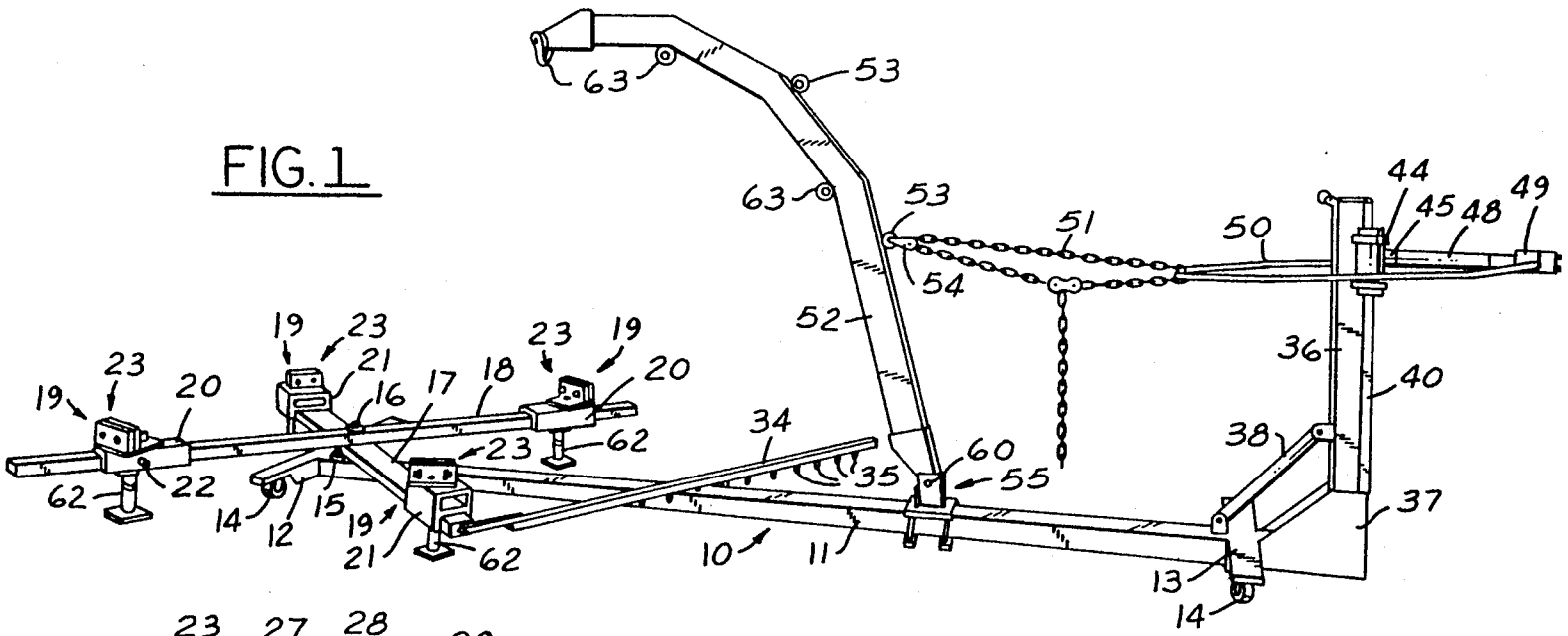
FIG. 1 is a perspective view of apparatus according to the invention.

The repair apparatus shown in the drawings includes a mobile base frame 10 having a longitudinal box-section member 11 with a front cross-member 12 and a rear cross-member 13, the base frame being supported by castor wheels 14 mounted under the ends of both cross-members 12 and 13.

A turntable 15 mounted near to the front of the base frame 10 has an axial shaft 16 on which there are centrally pivoted a lower carrier beam 17 and an upper carrier beam 18, each beam being capable of being pivoted independently of the other.

Figure 2:
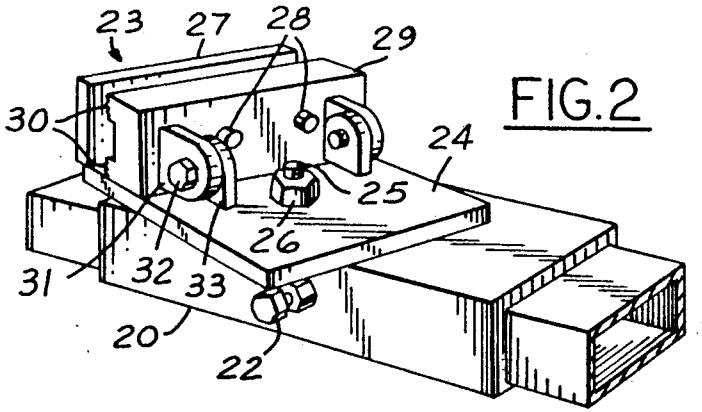
FIG. 2 is a perspective view of one of the vehicle sill clamps of the apparatus.

On each of the four arms formed of the assembly of carrier beams 17, 18, there is mounted an adjustable sill clamp assembly indicated generally at 19. Each of these sill clamp assemblies includes a rectangular-section sleeve, those of the upper carrier beam being indicated at 20, those of the lower carrier beam, of increased height so that the top all of the sleeves will be level, being indicated at 21. Each of the sleeves 20 and 21 is slidable on its carrier beam arm and may be releasably locked in place by a set screw 22. On each of the sleeves 20 and 21, there is pivotally mounted a clamp 23, see particularly FIG. 2, its base plate 24 being apertured centrally to receive a threaded stud 25 extending up from the top of the sleeve, passing through the aperture and engaged by a nut 26. The clamp 23 includes a plain first jaw 27 through which pass a pair of clamp bolts 28 threadedly engaged in a second jaw 29 formed with upper and lower serrated sections 30. A pair of hinge lugs 31 extending from the second or serrated jaw 29 are connected by hinge bolts 32 to a pair of hinge lugs 33 fixed on the clamp base plate 24. The clamp 23, then, may be pivoted about the stud 25 and locked in adjusted position by tightening the nut 26, and the pair of jaws 27 and 29 may be tilted about the axis of the hinge bolts 32 and locked in required position by tightening these bolts, the clamp being operated or released by tightening or slackening the clamp bolts 28. In this manner, a vehicle may be securely clamped on the carrier beams 17 and 18, and it may be easily rotated, the carrier beam assembly turning about the axial shaft 16 of the turntable 15. The vehicle may then be locked releasably in desired position by means of a locking brace 34 having one end pivoted to an end of the lower carrier beam 17 and having a series of downwardly extending pegs 35, any selected one of which may be dropped into a hole in the longitudinal box-section member 11.

Figure 5:
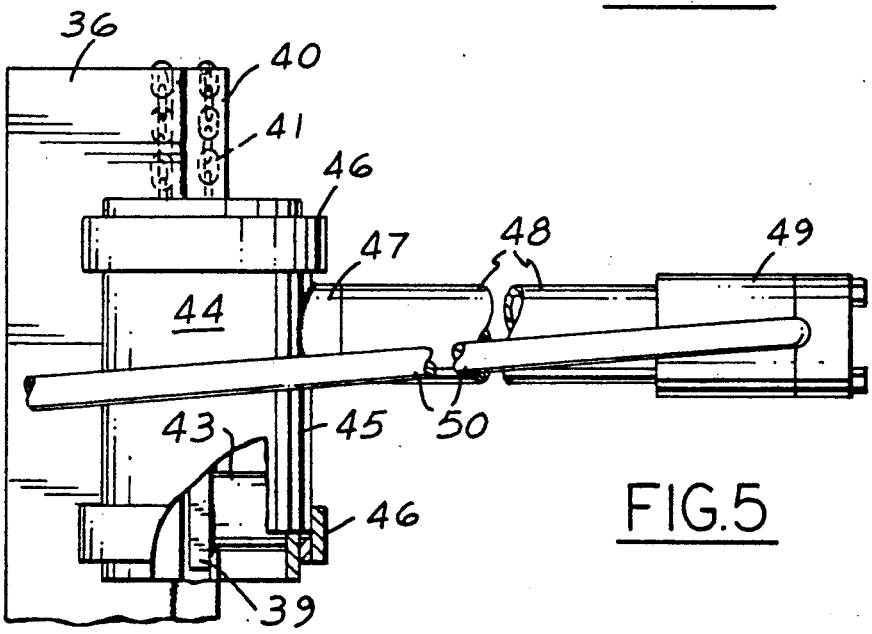
FIG. 5 is a partly broken-away side elevational view of an adjustable pulling mechanism of the apparatus.
Figure 6:
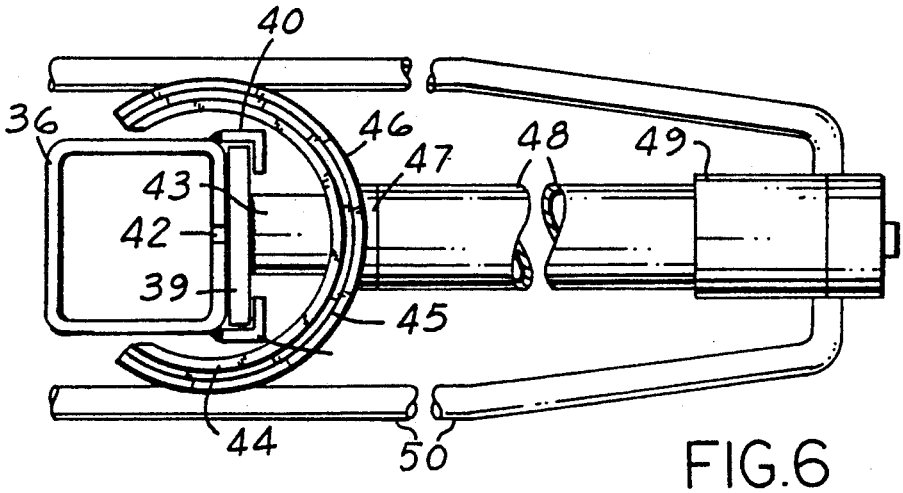
FIG. 6 is a plan view of the mechanism shown in FIG. 5.

A box-section standard 36 extends up from the rear end of the box-section member 11 and is reinforced by gussets 37 and a stay 38. A traveller 39 (see FIGS. 5 and 6) is retained slidably against the rear of the standard by a pair of angle members 40 welded to the rear corners of the box-section standard and is releasably held in required adjusted height by a chain 41 (omitted from FIG. 6), fixed to the traveller 39 and carried up, and dropped down into the box-section standard, 36 one link engaging in a slot 42 in the top of the box-section standard. A series of spacer blocks 43 welded to and extending rearwardly of the traveller 39 are welded at their rear ends to the middle part of a guide plate 44, which, as shown in the plan view of FIG. 6, is arcuately curved, with its extremities close to the sides of the box-section standard 36. An arcuately curved slide plate 45 is slidable from side to side of the guide plate, being retained against the guide plate by a pair of arcuately curved angled rails 46 fixed about the upper and lower parts of the guide plate 44.

Welded to the upper part of the slide plate 45 is a boss 47 engaged with one end of a hydraulic ram 48 which extends perpendicularly to the box-section standard 36. The other end of the ram is engaged in ram adaptor 49 in which is pivoted the rear end of a draw yoke 50 in the form of an elongated loop, the sides of which clear the sides of the guide plate 44. A chain 51 is looped through the other or front end of the draw yoke 50.

Figure 3:
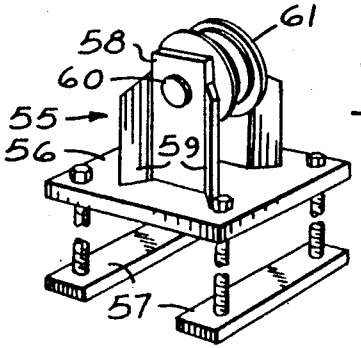
FIG. 3 is a perspective view of the mounting bracket according to the invention.
Figure 4:
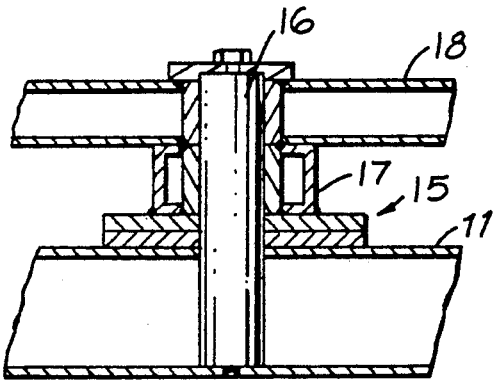
FIG. 4 is a sectional detail drawing showing the pivotal arrangements of the carrier beams.

In the arrangement shown in FIG. 1, the chain 51 is used, with the draw yoke 50, to connect the ram 48 to a curved boom arm 52 having two eyes 53 to either of which the chain may be connected by a shackle 54. The bottom of the boom arm is fulcrumed in an adjustable mounting bracket 55 shown generally in FIG. 3. This bracket has a plate 56 secured adjustably to the longitudinal box-section member 11 by a pair of U-bolts 57, a pair of parallel lugs 58, reinforced by gussets 59, extending up from the plate 56 and apertured to accept a pin 60 which serves as a fulcrum for the boom 52 or, as shown in FIG. 3, may carry a pulley wheel 61 if the boom arm 52 is first removed from the mounting bracket 55.

In use, the vehicle is mounted above the carrier arms 17 and 18, secured by the adjustable sill clamp assemblies 19 and rotated to the required position in which it is held by the locking brace 34, the clamp assemblies 19 then being stablised by adjustable jacks 62. The chain 51 may be connected directly from the draw yoke 50 to a part of the vehicle to be pulled or, as shown in FIG. 1, the chain may be connected to the boom arm 52 which has anchorage points at 63 any of which may be connected to a part of the vehicle by a further chain (not shown), cable or the like. As a further alternative, the boom arm 52 may be disengaged from the mounting bracket 60 and replaced by the pulley wheel 61 and, after the hydraulic ram 48 and its associated parts have been lowered, the chain 51 may be carried under the pulley wheel 61 and then upwards to a part of the vehicle to be pulled by the operation of the hydraulic ram.

It will be appreciated that the mounting of the hydraulic ram 48, permitting its vertical adjustment and also its oscillation about a vertical axis together with the draw 50, which furthermore, is pivoted about a horizontal axis to the ram adaptor 49, enables direct pulls to be achieved between hydraulic the ram and the part of the vehicle to which it is connected. The boom arm 52 may be reversed for working inside the vehicle.

The mounting bracket 55 may be used for mounting a variety of tools (not shown) on the base frame 10 of the apparatus; for example a telescopically adjustable post carrying an adjustable clamp which may be generally similar to the sill clamps 23.

Apparatus according to the invention will be found to be very effective in achieving the objects for which it has been devised, and very versatile in its applications, as well as being simple and economical to manufacture and readily mobile and capable of being conveniently stored in a fairly small area.

It will, of course, be understood that the particular embodiment of the invention herein described and illustrated may be subject to many modifications of constructional detail and design, which will be readily apparent to skilled persons, without departing from the scope of the invention hereinafter claimed.

I claim:

1. Apparatus for use in repairing damaged vehicles comprising:

a base frame having a first end and a second end;

an assembly of carrier beams pivoted on said base frame for rotation about a first upright axis oriented vertically relative to said base frame, said assembly of carrier beams comprising:

two carrier beams, said two carrier beams comprising four carrier beam arms;

a turntable connected near to said first end of said base frame; and an axial shaft connected with said turntable, said two carrier beams being centrally pivoted in superimposed arrangement on said axial shaft, each of said two carrier beams being mutually independently pivotable on said axial shaft;

a plurality of clamps adjustably mounted on said assembly of carrier beams for clamping a vehicle supported on said assembly of carrier beams;

retaining means for releasably locking said assembly of carrier beams in a rotatably adjusted position relative to said base frame;

a standard connected with said base frame, said standard being oriented along a second upright axis parallel with respect to said first upright axis; and, said standard being located near to said second end of said base frame; and tensioning means, mounted for vertical adjustment with respect to said standard, for connection by a chain means to at least one pre-selected location on the vehicle that has been clamped on said assembly of carrier beams.

2. Apparatus according to claim 1, further comprising:

a sleeve mounted so as to be slidably adjustable on a respective one of each said carrier beam arms, each clamp of said plurality of clamps being mounted on a respective one of each said sleeve, each said sleeve being structured such that each said clamp is substantially level with respect to each other said clamp; and locking means connected each said sleeve for releasably locking each said sleeve in a slidably adjusted position.

3. Apparatus according to claim 2, wherein each of said clamps comprises:

a base plate rotatably mounted to a respective one of each said sleeve so as to permit rotation about a vertical axis perpendicularly oriented with respect to said respective sleeve;

a pair of mutually adjustably interconnected clamp jaws, one of said mutually adjustably interconnected clamp jaws being pivotably connected with respect to said base plate so as the be pivotable about an axis oriented horizontal relative to said base plate; and a pair of clamp bolts for mutually adjustably interconnecting said clamp jaws.

4. Apparatus according to claim 1, wherein said retaining means further comprises a locking brace pivotably connected at one end thereof to said assembly of carrier beams; and means for releasably locking said assembly of carrier beams at any one of a number of selectable locations relative to said base frame, thereby selectively orienting said assembly carrier of beams relative to said base frame.

5. Apparatus according to claim 1, wherein said tensioning means comprises:

a traveller movably connected with respect to said standard for slidable movement relative to said standard along said second upright axis;

means for releasably holding said traveller in a selected position relative to said standard along said second upright axis;

a hydraulic ram having a first end and a second end, said first end of said hydraulic ram being movably connected to said traveller in a substantially perpendicular relation with respect to said standard, said hydraulic ram being movably connected to said traveller so that said hydraulic ram may be oscillated about said second upright axis; and a draw yoke having a first end and a second end, said first end of said draw yoke being connected to said second end of said hydraulic ram, said second end of said draw yoke being connected to said chain means.

6. Apparatus according to claim 1, further comprising a mounting bracket mounted on said base frame for adjustable movement between said assembly of carrier beams and said standard.

7. Apparatus according to claim 6, further comprising a pulley wheel mounted to the mounting bracket for directing said chain means between said tensioning means and the vehicle clamped on said assembly of carrier beams.

8. Apparatus according to claim 6, wherein said mounting bracket carrier a fulcrum; said apparatus further comprising a boom arm pivotably connected to said mounting bracket at said fulcrum thereof, said boom arm having an anchoring point for anchoring said chain means thereto from said tensioning means, said boom arm having a second anchoring point for anchoring a second chain means to the vehicle clamped on the assembly of carrier beams.

9. Apparatus according to claim 6, wherein said mounting bracket carries a post oriented in a direction parallel with respect to said first and second upright axes; said apparatus further comprising a clamp device surmounting said post.

* * * * *